United States Patent [19]

Holzworth

[11] 4,193,193

[45] Mar. 18, 1980

[54] GUARD FOR CHAIN SAW

[76] Inventor: Adolph Holzworth, 909 Bellevue Ave., Hulmeville, Pa. 19047

[21] Appl. No.: 932,354

[22] Filed: Aug. 9, 1978

[51] Int. Cl.[2] ..... B27B 17/02

[52] U.S. Cl. ..... 30/382

[58] Field of Search ..... 30/382, 383, 384, 161

[56] References Cited

U.S. PATENT DOCUMENTS

| | | | |
|---|---|---|---|
| 2,348,612 | 5/1944 | Deacon | 30/382 |
| 3,754,328 | 8/1973 | Knerr | 30/382 |
| 3,808,684 | 5/1974 | Ludwig | 30/382 |
| 4,063,358 | 12/1977 | Hodge | 30/382 |

FOREIGN PATENT DOCUMENTS

| | | | |
|---|---|---|---|
| 746304 | 11/1966 | Canada | 30/382 |

*Primary Examiner*—Jimmy C. Peters

*Attorney, Agent, or Firm*—Zachary T. Wobensmith, 2nd; Zachary T. Wobensmith, III

[57] ABSTRACT

A rigid light weight guard for chain saws is provided which includes a bar of soft metal mounted to the chain saw motor housing which is of a width slightly less than the saw chain, and which extends over the top of the saw chain spaced therefrom and down over the end below the center line of the saw chain and which permits of downward, horizontal and upward through cutting without interference by the guard.

3 Claims, 3 Drawing Figures

GUARD FOR CHAIN SAW

BACKGROUND OF THE INVENTION

1. Field of the Invention

This invention relates to a rigid guard for chain saws of the bar type which is affixed to the housing and extends above the saw chain for a substantial portion of its length.

2. Description of the Prior Art

It has long been recognized that a chain saw is a dangerous tool and a considerable number of guards have been proposed which were alleged to provide protection to the user.

A guard is shown in the U.S. Pat. to Blum No. 2,296,240 which includes a guard bar extending from a motor housing over the top of the saw chain to a strain head at the end of the saw.

The U.S. Pat. to Deacon No. 2,348,612 shows a chain saw with a U-shaped enclosure which extends over the upper reach of the saw chain.

The U.S. Pat. to Forrest No. 2,432,567 shows a chain saw with a guide detachable head, a guard extending from the motor end to a helpers handle at the other end of the chain saw, and with both ends of the saw chain enclosed.

The U.S. Pat. to Pratt No. 2,618,298 shows a bow frame chain saw which has a saw chain guard of channel shape secured to a rail 7 and which terminates inwardly of the exposed curved end of the saw chain.

The U.S. Pat. to Hampton No. 4,060,894 shows a U-shaped straight guard 15 pivotally mounted to the motor housing of a chain saw extending over the length of the saw chain and which guard pivots upwardly during use.

None of the references show a fixed light weight guard for a chain saw that does not interfere with the saw operation and which obviates the disadvantages of the other saw guards.

None of the references shows a fixed guard for a chain saw which permits both downward, horizontal and upward through cutting with the saw of an object larger than the saw and without interference by the guard with the cutting while still providing protection.

SUMMARY OF THE INVENTION

A rigid light weight guard for chain saws is provided which is attached to the motor housing, extends fowardly therefrom, is spaced above the saw chain, the thickness of the guard being slightly less than that of the saw chain and which terminates at a point below the centerline of the saw chain at the front thereof, thereby permitting of downward, cross or upward cutting without interference and of logs which exceed in size the top to bottom dimension of the saw.

The principal object of the invention is to provide a guard for chain saws that is simple and inexpensive to construct but which provides an effective guard for the saw chain.

A further object of the invention is to provide a guard for chain saws that can be easily attached and detached from most existing chain saws without major modification thereto.

A further object of the invention is to provide a guard for chain saws which protects the saw by preventing a sawed log from pinching and causing damage to the chain.

A further object of the invention is to provide a guard for chain saws that does not interfere with the normal operation of the chain saw and permits of downward, cross and upward cutting with the saw.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
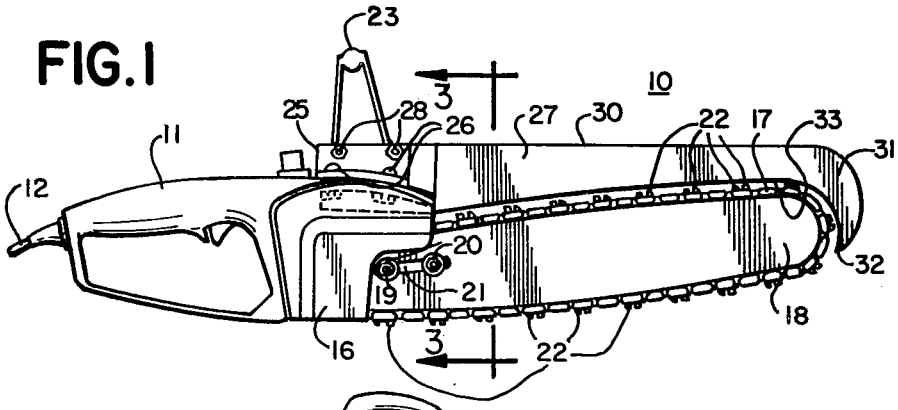
FIG. 1 is a side elevational view of a chain saw having mounted thereon a guard in accordance with the invention.
Figure 2:
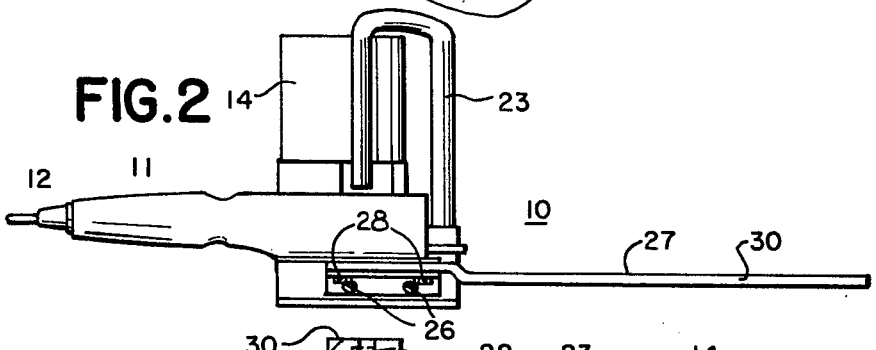
FIG. 2 is a top elevational view of the chain saw with the guard as illustrated in FIG. 1.
Figure 3:
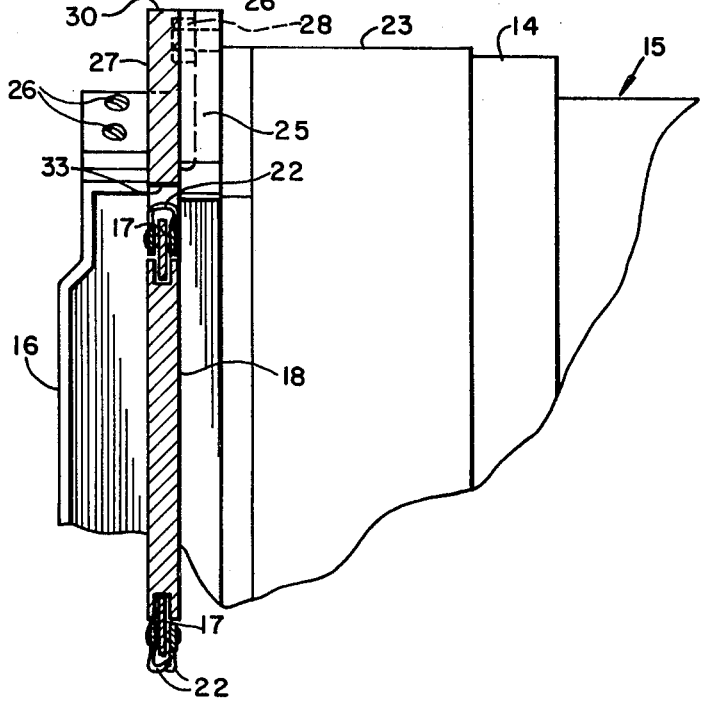
FIG. 3 is a vertical sectional view, enlarged. taken approximately on the line 3—3 of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, a chain saw 10 is illustrated therein, of well known type and which is shown as being of the electric motor driven type but which could be gasoline motor operated if desired. The chain saw 10 includes a grip frame 11 with electric leads 12 extending therefrom to a source of electrical energy (not shown). A switch 12 is provided for control of an electric motor 14 carried in a housing 15 which is attached to the grip frame 11.

The housing 15 has a plate 16 which covers the saw chain 17 at the point where it is engaged by a sprocket (not shown) of well known type driven by the electric motor 14. The saw chain 17 is carried by a chain bar 18 which is detachably secured to the housing 15 by two bolts 19 and nuts 20 with the bolts 19 engaged in a slot 21 in bar 18. The saw chain 17 is provided with chain teeth 22 positioned in spaced relationship on chain 17 to effect cutting.

A hand hold 23 is provided attached to frame 11 for engagement by the hand of the user which is not engaged with the grip frame 11.

The housing 17 also has a bracket 25 detachably secured thereto by bolts 26 extending upwardly therefrom and to which the guard 27 of the invention is detachably secured by bolts 28.

The guard 27 is of a generally rectangular shape, and preferably fabricated of soft aluminum.

The guard 27 which is affixed to bracket 25 has a straight upper edge 30 which extends over the saw chain 12 to a curved tip 31 which extends down over the end of the saw chain 17 to a point 32 below the centerline of the chain 12 and the chain bar 18. The guard 27 on the lower edge 33 is curved to follow the contour of the saw chain 17 and chain bar 18 and in a preferred embodiment is spaced approximately one half inch above the chain teeth 22.

The guard 27 is of a width slightly less than the chain teeth 22 to preclude binding upon operation of the chain saw 10. The saw teeth 22 can be brought against the log, tree or limb to be cut downwardly, crosswise or upwardly without any interference by the guard 27 or displacement thereof.

It will thus be seen that a chain saw guard has been provided with which the objects of the invention are attained.

I claim:

1. In combination with a chain saw having a housing containing a motor, a grip frame engaged with the motor housing, an exposed saw chain carried on an exposed chain bar detachably secured to the housing, a guard which comprises an elongated rigid bar of flat material fixedly attached to said motor housing and extending in spaced relation above said saw chain a distance greater than the length of said chain bar, said bar being of a width less than the width of the saw chain.

2. A guard as defined in claim 1 in which said bar extends over the end of said chain and said chain bar to a point below the center line of said chain bar.

3. A guard as defined in claim 1 in which said guard is made of sheet aluminum.

* * * * *